United States Patent [19]

Sensabaugh et al.

[11] Patent Number: 4,660,577

[45] Date of Patent: Apr. 28, 1987

[54] DRY PRE-MIX FOR MOIST SNUFF

[75] Inventors: Andrew J. Sensabaugh; Ronald L. Parks, William P. Mangan, all of Winston-Salem; Arvol C. Marsh, Rural Hall, all of N.C.

[73] Assignee: R.J. Reynolds Tobacco Company, Forsyth, N.C.

[21] Appl. No.: 741,028

[22] Filed: Jun. 3, 1985

Related U.S. Application Data

[63] Continuation of Ser. No. 410,091, Aug. 20, 1982, abandoned.

[51] Int. Cl.[4] ..... A24B 3/12; A24B 3/18; A24B 15/20

[52] U.S. Cl. ..... 131/352; 131/290; 131/300; 131/303; 131/308; 131/310

[58] Field of Search ..... 131/742, 290, 324, 300, 131/302, 303, 308, 309, 310, 352

[56] References Cited

U.S. PATENT DOCUMENTS 4,392,501 7/1983 Nealton et al. ..... 131/290

OTHER PUBLICATIONS

*Tobacco Dictionary* edited by R. Jahn, Philosophical Library, N.Y., U.S.A., date 3/11/1955.

*Primary Examiner*—V. Millin
*Attorney, Agent, or Firm*—Kenyon & Kenyon

[57] ABSTRACT

A dry pre-mix is provided whereby a moist snuff can be prepared by addition of water. The pre-mix consists of a mixture of snuff-type tobaccos, cut to a predetermined size and having a moisture level between 6% and 16%.

10 Claims, No Drawings

DRY PRE-MIX FOR MOIST SNUFF

This is a continuation of co-pending application Ser. No. 06/410,091 filed on Aug. 20, 1982, now abandoned.

BACKGROUND OF THE INVENTION

This invention relates to a novel tobacco product. More particularly, the invention relates to a dry, finely-cut tobacco mixture, to which a consumer may add water to produce moist snuff.

Snuff is one of the oldest tobacco products known. Two types exist, dry snuff and moist (or wet) snuff. The former is produced as a dry powder. The latter product is produced from similar tobacco blends but is finely cut rather than ground, and it has a high moisture level. The present invention concerns moist snuff, and further discussion will be limited to that product.

The properties of snuff, as with any tobacco product, are determined primarily by the tobacco blend and processing variables. Important variables include the temperature/time relationship during processing, the cut, casing, top dressing, and final moisture content.

The tobacco blend is crucial to achieving proper snuff flavor and color characteristics. For example, cigarette tobacco blends normally include large amounts of Burley, Flue-cured, and Turkish tobaccos. Snuff derives many of its characteristics from the use of "snuff-type" tobaccos, such as Dark Fired, Green River, and One-Sucker tobaccos, primarily from Tennessee and Kentucky. Snuff-type tobaccos can be characterized chemically by a high level of nitrogenous constituents, particularly nicotine. Physically, these tobaccos are heavy-bodied, having long wide leaves. Use of these types of tobacco is dictated by considerations of flavor and the ability to withstand processing; other type tobaccos tend to degrade physically when subjected to snuff processing. A modern snuff mixture might also contain a significant percentage of other tobacco materials, such as rolled stems. A traditional snuff blend, for example, could contain 70% Dark Fired tobacco, 10% each of One-Sucker and Green River, with 10% of a more common tobacco variety, such as Burley. To provide the taste and color characteristics the consumer has come to expect from snuff, however, the blend's major constituents must be snuff-type tobaccos.

Casing and top dressing (flavoring) is extensively used in snuff production. The distinction between these two operations is that casing materials normally are applied during processing operations, while top dressing, or final flavoring, usually is applied as a final, or near-final step. A wide variety of flavorants has found acceptance among snuff consumers. Mint, attar of rose, fruit, and wintergreen flavors enjoy considerable market acceptance.

The time-temperature relationship in snuff manufacturing differs considerably from other tobacco processes. Traditionally, the snuff manufacturing process requires up to 18 months, in addition to the two—four years' storage in hogsheads. Even though modern techniques have reduced processing time to the three to four month range, the processing scheme closely follows traditional methods. Tobacco is removed from the hogsheads, at which time it has a moisture content between 20 and 22%. Casing material is added, raising the moisture level above about 40%. The wet tobacco is then stored at room temperature, producing an environment highly conducive to bacterial growth. The resulting fermentation releases heat, raising the temperature of the mixture and promoting further bacterial growth and fermentation. This process is allowed to continue 60 to 90 days, until the manufacturer is satisfied that a proper flavor level has been achieved. The decision to proceed with processing relies upon art rather than pure science. The primary differences between traditional and modern processing methods are the realization that acceptable flavoring can be produced in reduced time, and the use of cold storage to abort the fermentation when desired flavor levels are achieved.

Different tobacco products are also characterized by different techniques used in cutting the tobacco. In all snuff manufacturing, however, tobacco strips (the portions of the tobacco leaf remaining after removal of the stems) are subjected to a double cutting process. The standard measure of tobacco cutting processes is the number of cuts made per inch of tobacco strip. For example, cigarette tobacco filler undergoes about thirty-two cuts per inch. Here, the moist snuff tobacco initially is coarsely shredded at about twenty cuts per inch, and after fermentation, it is subjected to a second cutting process. Rather than shredding, here the tobacco is run through a hammer mill, where the tobacco is comminuted into small particles. This second cutting process is roughly equivalent to a single cut at about ninety cuts per inch.

Moisture content has proven crucial to consumer perception of snuff quality. Unlike other tobacco processes, the moisture content is not carefully controlled and varied during processing; rather, final moisture content adjusted to a desired level immediately prior to packing. Moist snuff processing further is unique in that the entire process is conducted at elevated moisture levels. After the initial addition of casing material, the tobacco remains above the 40% moisture level, and it must be packed at a moisture level between 48 and 55%. This level has proved a crucial variable, because customers can perceive moisture differences of as little as 3% and will reject such a product as being too dry and too light in color.

Maintaining an acceptable moisture level between production and consumption is the major problem facing moist snuff producers. The product tends to lose moisture in the packing process, and it experiences additional moisture losses after packaging. Moist snuff normally is marketed in a cardboard, wax-coated container which is highly permeable to moisture. Tests reveal that if such a container is allowed to remain unopened at room temperature for sixty days, moisture content of the product will drop from 55% to 32%. Long before that point, of course, the product would have become unacceptable to consumers. Replacement of the normal packaging material with an hermetically sealed container would not solve this problem, because the fermentation process is continuing, albeit at a low level. Even at a low level, however, some gas is evolved. Thus, an hermetically sealed container would result in unacceptable pressure buildup inside, leading to bulging, buckling, and ultimate failure of the container. Plastic containers, recently tested as replacements for the traditional cardboard, have featured vent holes to allow gas to escape. Because moisture will also escape through such holes, changing the packaging material will not eliminate this seemingly inherent problem of moist snuff. Of course, moisture loss accelerates after the can has been opened.

This problem has led to moist snuff being marketed as a highly perishable product. The combination of moisture loss and the small amount of product consumed at one time has dictated a small package; the container normally used in the art contains only 1.2 ounces. Further, a leading producer of moist snuff date stamps each can and has established a distribution system that rapidly moves the product from the factory to the shelf, apparently the only possible response to consumer demand for fresh product. Consumer surveys demonstrate that snuff users look for fresh product and are willing to go out of their way to find it.

Given the limitations inherent in the product, the prior art has found no solution to the problem of obtaining a moist snuff having a stable shelf life. Rather, the industry seems content to maintain the existing cumbersome and expensive distribution system and to endure spoilage and consumer dissatisfaction.

SUMMARY OF THE INVENTION

Applicant has discovered that it is possible to provide a tobacco product at a low moisture level, to which the consumer can add a measured quantity of water to produce moist snuff. Elimination of the moisture level problem will free the industry from the burdens of small containers, cumbersome distribution, and extensive consumer dissatisfaction. The product can be provided to customers either in bulk or in suitable containers which permit easy and accurate measurement for addition of the correct amount of water.

An object of this invention is to provide a dry tobacco product which, when mixed with the correct amount of water, will produce a moist snuff.

A further object of this invention is to produce a tobacco product, to be consumed as a moist snuff, having a substantially longer shelf life than presently known moist snuff products.

Another object of this invention is to provide a moist snuff product which will allow consumers to obtain product in reasonable quantities, without sacrificing freshness.

DETAILED DESCRIPTION OF THE INVENTION

Dry pre-mix for moist snuff is produced in a manner radically different from the traditional moist snuff process. Initially the aging process is reduced to a maximum of two to three years in hogsheads, and the moisture content upon removal from the hogsheads is in the range 12–14%. The tobacco is then blended, using techniques and apparatus known in the art. Either before or after blending, the moisture level is adjusted to about 12–18% in apparatus such as reordering drums, normally employing steam conditioning. The exact blend may vary according to the taste characteristics desired, but snuff-type tobaccos should constitute the major portion of the mixture. Applicant's preferred embodiment consists of 5–25% Dark Fired tobacco, 10–30% Green River, 30–50% One-Sucker and up to 40% other tobacco materials. At this stage, casing materials such as water, licorice, flavorants, and sugars may be added to the tobacco. This step normally is carried out at an elevated temperature, preferably 140°–180° F. (60°–82° C.)

At this point, the tobacco enters a forced aging stage. Forced aging simulates the result of the traditional fermentation step by inducing natural chemical reactions, known as Maillard reactions, in the tobacco, which produce browning reactions in the sugars present therein. These reactions result in darkening the tobacco and producing snuff flavor precursors. The tobacco mixture emerges from the previous casing step at a temperature between about 160° and 190° F. (71°–88°), preferably 190° F. (88° C.), whereupon it is placed into containers. The mixture remains within these containers between about 24 and 48 hours. The Maillard reactions are induced by maintaining the tobacco at this elevated temperature during the holding period. This temperature can be maintained by applying external heat to the container holding area, as with steam, or simply by maintaining the containers within an insulated area and allowing the heat liberated by the Maillard reactions to maintain the proper temperature. With either method, the tobacco temperature rises to about 200° F. (93° C.). The resulting product closely simulates that produced through traditional fermentation, but it does so in one to two days rather than two to three months. The product emerges from the forced aging step having a moisture content between 10 and 14%, rather than the elevated moisture level of over 40% found in the prior art.

The mixture is then fed into a cutter, of which many types are well-known in the art. Cutting parameters can be varied depending upon the desired degree of fineness in the finished product, within a normal range of 40–120 cuts per inch. Applicant prefers a double cut, using two cutters rather than the cutter/hammer mill combination used in the prior art. The first cutter is set at about 32 cuts per inch, and the second at about 90 cuts per inch.

Here, those skilled in the art would adjust the moisture level to 55% preparatory to packing. Applicant, however, proceeds directly to addition of top dressing to the dry tobacco. In this final step, pH may be adjusted by addition of ammonium carbonate, sodium bicarbonate, or other additives; salt and flavorants such as wintergreen or mint are added to produce the desired flavor, both steps being known to the art.

The product, still having a moisture content between about 6 and 16%, preferably 10–14%, is then packed and shipped to consumers.

Conversion of the product from a dry pre-mix to moist snuff occurs in the hands of the consumer. The exact method of conversion depends primarily upon the packaging means selected. One method would be to market the pre-mix in bulk, providing a small container in which the consumer could prepare moist snuff as needed. Another method might be to market relatively small containers, with instructions to prepare moist snuff within that container. Still another method would be to market the product in multi-cell flexible packaging, with one cell containing pre-mix and another containing water. By applying pressure, the customer could rupture the seal between the pre-mix and the water, and simply by kneading the resulting mixture, produce moist snuff.

It should be understood that variations in the method of production and in the product itself will be obvious to those having skill in the art. For example, the proportions or types of snuff-type tobaccos may be altered, or the time/temperature relationships could be varied to produce desired flavors. Such variations are included within the scope of the present invention.

I claim:

1. A dry pre-mix for making moist snuff by later addition of water, comprising an aged tobacco blend containing at least 50% snuff-type tobaccos and snuff flavor precursors, having a moisture content between about 6 and 16%, and comminuted into particles, substantially all of said particles having a width between about 1/40 and 1/120 inch (0.6 and 0.2 mm) wide.

2. The dry pre-mix of claim 1, wherein said moisture content is between about 10 and 14%.

3. The dry pre-mix of claims 1 or 2, wherein said comminuted particles have a width of about 1/90 inch (0.28 mm).

4. A process for producing a dry pre-mix for making moist snuff by later addition of water comprising the steps of providing select tobaccos including snuff-type tobaccos for blending;

blending said tobaccos to produce a blended tobacco containing at least 50% snuff-type tobaccos;

cutting the blended tobacco into comminuted particles having a width between about 1/40 and 1/120 inch;

casing the cut blend with flavorants and water;

thereafter elevating the temperature of the cut blend to about 200° F. (93° C.) and maintaining said elevated temperature for a time sufficient to force age the blend while producing snuff flavor precursors and imparting a final moisture content between about 6 and 16%;

adjusting the pH of the force-aged blend and adding flavorant to form a pre-mix; and packing the pre-mix.

5. The process of claims 4, wherein said forced-aging step results in said final moisture content of said blend being between 10-14%.

6. The process of claim 5, wherein said sufficient time for said forced-aging step is about 24 to 48 hours.

7. The process of claims 4, 5, or 6, wherein said cutting step cuts said blend into comminuted particles having a width of about 1/90 inch (0.28mm).

8. A dry pre-mix for making moist snuff, said pre-mix comprising a comminuted tobacco blend of aged tobacco cut to a degree of fineness within a range of from 40 to 120 cuts per inch and containing casing material and snuff flavor precursors, a major portion of said blend including snuff-type tobacco characterized chemically by a high level of nitrogenous constituents; and moisture in an amount of between 6% to 16%.

9. A dry pre-mix as set forth in claim 8 wherein said moisture is in an amount between 10% and 14%.

10. A dry pre-mix as set forth in claim 8 characterized in being able to absorb moisture up to an amount of from 48% to 55% to form a moist snuff.

* * * * *

UNITED STATES PATENT AND TRADEMARK OFFICE

CERTIFICATE OF CORRECTION

PATENT NO. : 4,660,577

DATED : April 28, 1987

INVENTOR(S) : Andrew J. Sensabaugh, et al

It is certified that error appears in the above-identified patent and that said Letters Patent is hereby corrected as shown below:

Face page, under Assignee, change "R.J. Reynolds Tobacco Company, Forsyth N.C." to -Alfred & Christian Peterson, Ltd., Owensboro, Kentucky-

Signed and Sealed this

Twenty-seventh Day of October, 1987

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,660,577

DATED : April 28, 1987

INVENTOR(S) : Andrew J. Sensabaugh, et al

It is certified that error appears in the above-identified patent and that said Letters Patent is hereby corrected as shown below:

Column 1, line 13 "exist." should be "exist,-

Column 1, line 16 "ground." should be -ground,-

Signed and Sealed this

Nineteenth Day of July, 1988

*Attest:*

DONALD J. QUIGG

*Attesting Officer*

*Commissioner of Patents and Trademarks*